US009631804B1

(12) United States Patent
Glenn

(10) Patent No.: US 9,631,804 B1
(45) Date of Patent: Apr. 25, 2017

(54) COMBINATION FAN AND LIGHT ATTACHABLE TO A HAT

(71) Applicant: Joseph Gregory Glenn, Niceville, FL (US)

(72) Inventor: Joseph Gregory Glenn, Niceville, FL (US)

( * ) Notice: Subject to any disclaimer, the term of this patent is extended or adjusted under 35 U.S.C. 154(b) by 113 days.

(21) Appl. No.: 14/250,576

(22) Filed: Apr. 11, 2014

Related U.S. Application Data

(63) Continuation-in-part of application No. 13/360,434, filed on Jan. 27, 2012, now Pat. No. 8,807,814.

(51) Int. Cl.
*F21V 21/084* (2006.01)
*F21V 33/00* (2006.01)
*F21V 5/04* (2006.01)

(52) U.S. Cl.
CPC ..... *F21V 33/00* (2013.01); *F21V 5/04* (2013.01)

(58) Field of Classification Search
USPC ..... 362/103, 105, 106, 577, 580; 2/171, 2/171.3, 209.13
See application file for complete search history.

(56) References Cited

U.S. PATENT DOCUMENTS

2003/0138321 A1* 7/2003 Somahara ..... F04D 29/703 415/121.2
2004/0008157 A1* 1/2004 Brubaker ..... G02B 27/0176 345/8
2009/0031475 A1* 2/2009 Ochoa ..... A42B 1/244 2/171.3
2011/0050183 A1* 3/2011 Ginet ..... H02P 9/10 322/86

* cited by examiner

*Primary Examiner* — Andrew Coughlin
*Assistant Examiner* — Meghan Ulanday
(74) *Attorney, Agent, or Firm* — Peter Loffler

(57) ABSTRACT

A light and fan assembly has a generally tubular housing that has a turbine fan located on one end, the fan discharging a stream of air therefrom, and a light located on the opposing end, the light discharging a light beam therefrom in opposite direction to the direction of the air stream. A clip clips the housing to an appropriate surface such as a hat brim. A monocular is attached to the housing. Alternately, the fan can be held within an assembly that is pivotally attached to a lower surface of the housing.

10 Claims, 6 Drawing Sheets

COMBINATION FAN AND LIGHT ATTACHABLE TO A HAT

This application is a Continuation-In-Part of U.S. patent application Ser. No. 13/360,434, filed on Jan. 27, 2012, which is incorporated herein by reference in its entirety.

BACKGROUND OF THE INVENTION

1. Field of the Invention

The present invention relates to a fan and a light each held within a single housing yet each operable independently of one another, the housing attachable to the brim of a hat or similar structure.

2. Background of the Prior Art

Keeping cool in the summer heat can often be a challenge. Indoor and automotive air conditioning is standard operating fare in most situations, allowing a person who is at home or the office or who is commuting to be able to stay relatively cool. However, often the great indoors are not to be had and the hot air can suck the energy out of a person. For example, sitting in an outdoor baseball stadium watching nine innings, working in the yard, or walking around an amusement park with the kids, can all leave a person hot and sweaty.

One simple method for keeping cool has a person fanning him or herself. The most basic fan is a handheld fan with a short handle and a relatively flat or pleated surface, often made of paper or similar material, with the device being manually waved back and forth in order to create a breeze, often targeted at the person's face. While effective, this method of fanning is labor intensive and can only be comfortably performed for short durations. Another method for keeping cool uses an automatic fan that uses a small battery powered motor to spin a series of fan blades that create a breeze. While also effective and less labor intensive than a manual fan, these types of devices still require a person to hold the device during device operation, which holding becomes strenuous after a certain amount of time. Accordingly, these battery powered fans also tend to be used for relatively short periods of time.

In order to provide automatic fanning of a person's head, and to overcome the need to carry a motor and battery pack by hand, fan hats have been proposed. Such devices attach a fan—some even with a mini air conditioner thereat—to a hat with the fan providing a stream of air onto the person's head, often toward the facial area, in order to help fan the person and make the person more comfortable. Such devices use the person's head as support instead of requiring a hand carrying of the fan. If the device is relatively small, a head supported device can be carried indefinitely without introducing undue strain onto the person's head, neck or back.

Although these devices tend to be used for longer periods of time than a manual fan or a handheld fan, such devices are not without drawbacks. Some of the prior art devices are relatively large and require a substantial battery pack so that such devices can still become uncomfortable to a person after extended use. Some devices require an enclosed volume of air to be provided by the hat for proper device usage. Such hats, typically top hats, tend not to find favor with many wearers both from a fashion and a comfort point of view. Still other devices require a modification to the hat, especially if the fan directs air at the person's face. As such, such devices tend to be limited to a particular hat or require the user to make undesirable modifications to his or her hats, modifications, which many users are either unable or unwilling to make.

A separate problem encountered by people, is the need to provide artificial light in a variety of situations. Walking in a dark place, such as an unlit park or corridor, reading a menu in a dimly lit restaurant, or searching for an item in an awkward area, such as underneath a car seat, are all examples where artificial light is a welcome assistant.

A flashlight is a very common tool used to provide artificial light. Flashlight can be aimed as desired, are relatively lightweight, and with the new technologies in both electrical storage and bulbs, can last a relatively long time without the need to change or recharge the flashlight's batteries. While effective, many light challenged situations are not well suited for flashlight use. A person walking through a dark park or on a dark beach may have his or her hands full with the day's outing paraphernalia and carrying a flashlight may provide difficult. Often a person will place the flashlight into the arm pit area which is uncomfortable and makes the proper aiming of the flashlight difficult. Many people would not feel comfortable taking out a flashlight in a restaurant.

To address these problems, lights that are attachable to a hat have been proposed. These devices allow placement of a flashlight or similar light producing system (some use candles) onto a person's headwear and allow the person to carry the light and aim the light via his or her head, freeing up the hands for other uses. Some of the prior art devices are relatively complex in design and tend to be heavy so that extended use of such devices can become uncomfortable.

What is needed is a device that solves both of the above stated needs in the art by providing a device that cools a person's face while allowing the person to be able to cast a light beam in a desired direction. Such a device must be head operated in that the device is carried via the person's head as opposed to his or her hands and is directionally controlled by the head so that the person can use the hands for other tasks. Such a device must be relatively light weight so that it can be carried by the person's head for extended periods of time without becoming gravitationally uncomfortable. Such a device must not require that the person wear a top hat or a specialized hat for use or require the person make significant modifications to existing hats. Ideally, such a device should be of relatively simple design and construction so as to be relatively easy to produce in order to keep the costs of such a device at a reasonable level so as to make the device readily affordable to a large segment of potential consumers for this type of device.

SUMMARY OF THE INVENTION

The combination fan and light attachable to a hat of the present invention addresses the aforementioned needs in the art by providing a single device that blows cooling (or possibly heating) air across a person's face and provides a light beam that is amiable by the person, without the need to use the hands for carrying or directional control of the device. The combination fan and light attachable to a hat is relatively light so that extended carrying of the device, whether operational or not, does not pose an undue strain onto the person's head, neck, shoulders, or back. The combination fan and light attachable to a hat is simple in design and construction, and does not require the use of a specific style of hat and does not require extensive modifications to an existing hat. The combination fan and light attachable to a hat is produced using standard manufacturing techniques. This makes the potential price point of the device relatively low so as to allow the device to be readily affordable to a large segment of potential consumers for this type of product.

The combination fan and light attachable to a hat is comprised of a tubular housing that has a first end and a second end. A fan is located on a first end of the housing such that fan is capable of issuing an air stream outwardly from the first end of the housing in a first direction. A light assembly is located on a second end of the housing member such that the light assembly discharges a beam of light outwardly from the second end of the housing in a second direction that is opposite in direction to the first direction. A clip is attached to the housing and has an opening facing toward the first end of the housing, the clip being used to clip the housing to the brim of a hat or other appropriate surface. The fan may be a turbine fan. A diffuser overlays the fan so that the air stream passes through the diffuser. Intake vanes are located on housing such that the fan draws a column of working air for use in producing the air stream that the fan discharges. A monocular may attached to the housing either fixedly or removably.

Alternately, the combination light and fan attachable to a hat is comprised of a housing that has a first end and a second end. A light assembly is located on a first end of the housing such that the light assembly discharges at least one beam of light outwardly from the first end of the housing in a first direction. A fan assembly is pivotally attached to a lower surface of the housing such that the fan assembly has at least one fan that is capable of issuing an air stream outwardly toward the second end of the housing. A clip is attached to the housing and has an opening that faces the second end of the housing in order to clip the housing to a brim of a hat or similar surface. The fan may be a turbine fan. At least one diffuser vane overlays the fan so that the air stream passes through the diffuser vane. A filter cap is attached, either fixedly or removably (threadably, frictionally, etc.,) to the second end of the housing in overlaying relationship with the light assembly, such that filter cap has a split lens that has a first panel of a first tint and a second panel of a second tint that is different relative to the first tint such that the beam of light passes through the first panel and the second panel.

BRIEF DESCRIPTION OF THE DRAWINGS

Similar reference numerals refer to similar parts throughout the several views of the drawings.

DESCRIPTION OF THE PREFERRED EMBODIMENT

Figure 1:
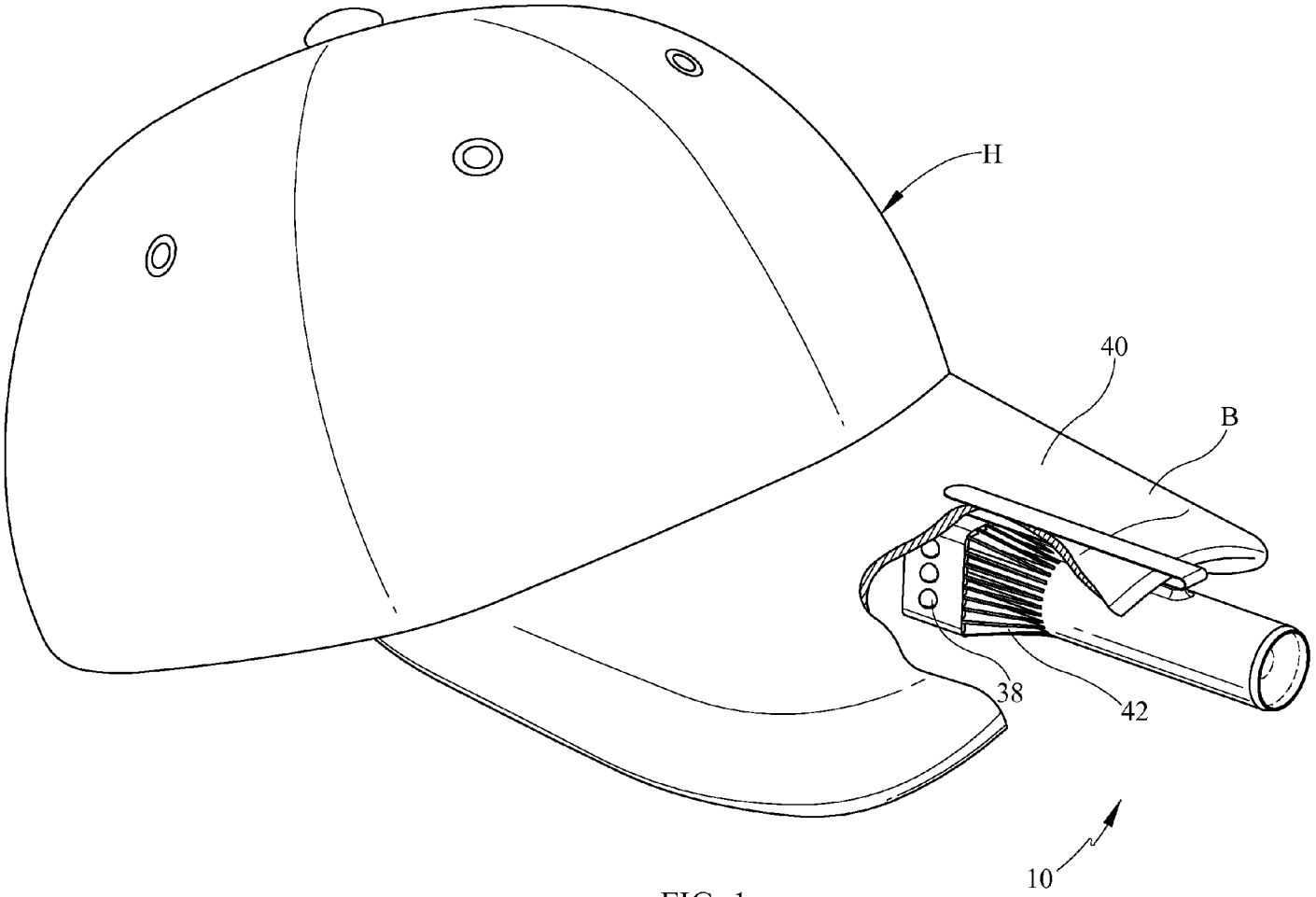
FIG. 1 is a fan side perspective view of the combination fan and light attachable to a hat of the present invention.
Figure 2:
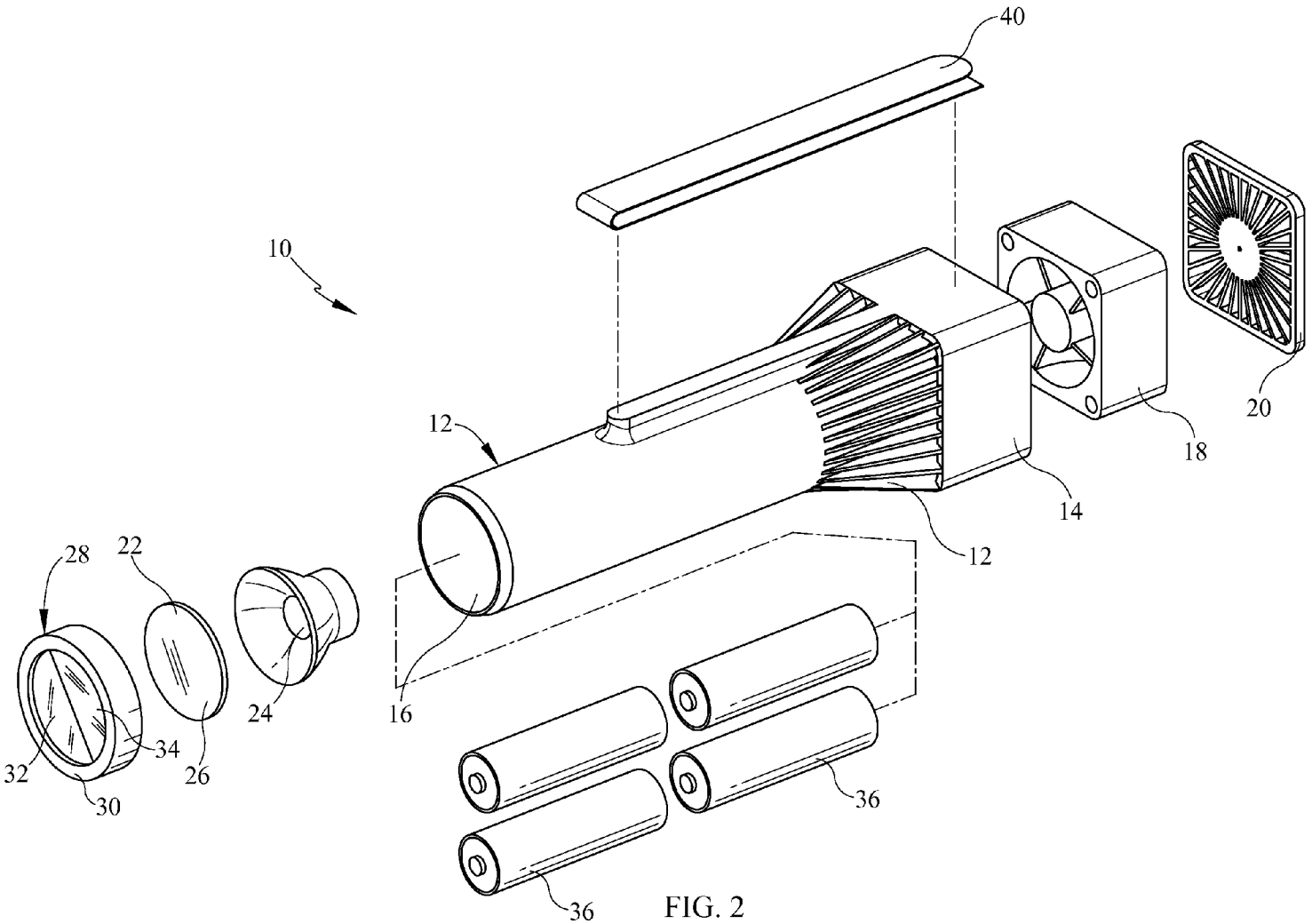
FIG. 2 is an exploded view of the combination fan and light attachable to a hat.
Figure 3:
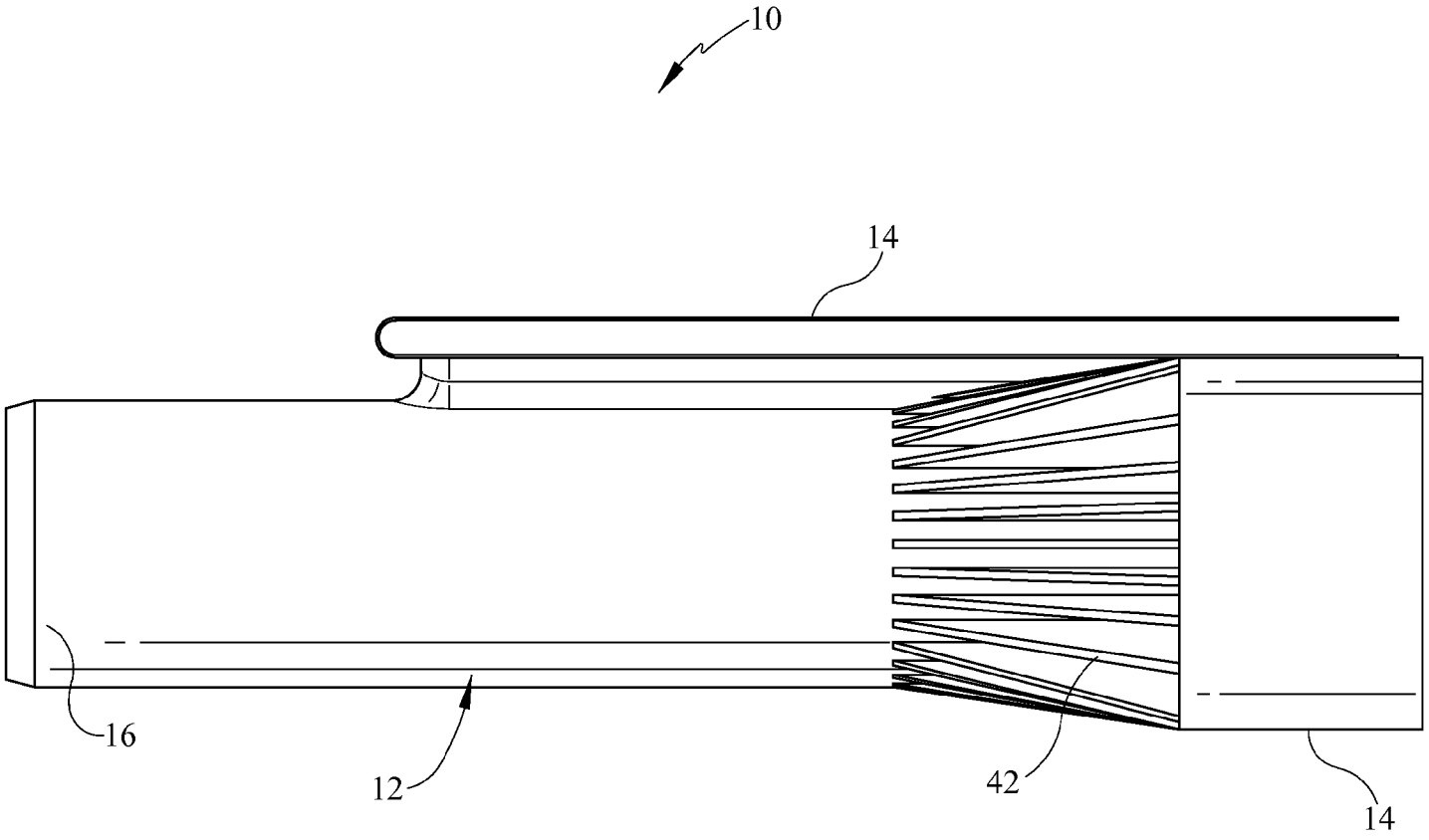
FIG. 3 is a side elevation view of the combination fan and light attachable to a hat attached to the brim of a cap.

Referring now to the drawings, it is seen that the combination fan and light attachable to a hat of the present invention, generally denoted by reference numeral 10, is comprised of a housing 12 that is an elongate, essentially hollow, tubular member having a hollow interior and having a first end 14 and an opposing second end 16. Disposed within the first end 14 of the housing 12 is a fan assembly that comprises a fan 18, such as the illustrated turbo fan that fits within the first end 14 of the housing 12 and is overlaid by a diffuser cap 20 that diffuses the air issued by the fan 18.

Disposed within the second end 16 of the housing 12 is a light assembly that comprises a reflector 22 of appropriate design with a light bulb 24 nested therein and a lens 26 covering the light bulb 24 and reflector 22. The lens 26 may have appropriate filter properties or a separate filter cap 28 may removably overlay the lens 26. The light bulb 24 may be of any appropriate design including an LED bulb, and may also be a laser type bulb so that the combination fan and light attachable to a hat 10 can be used as a laser aiming device. As seen, the optional filter cap 28 has a housing 30 that holds lens formed from a first panel 32 and a second panel 34, forming the illustrated split lens, split essentially down the middle. The first panel 32 may be of a first color while the second panel 34 may be of a second color.

Held within the housing 12 is one or more batteries 36 that provide a source of electrical power to both the fan 18 and the light bulb 24, with the device electrically wired in the usual way (not illustrated). One or more control switches 38 control operation of the fan 18 and the light bulb 24 and can include the typical functions of a fan 18 and light bulb 24 respectively, including the speed of the fan 18, the intensity of the light bulb 24, the cycle of the light bulb 24 the light bulb 24 can be designed to flash or flicker for use during night bicycle riding, for example, in order to be more readily visible to others on the road).

A clip 40 is attached to the housing 12, removably or fixedly, and has its opening facing toward the fan 18. A series of inlet vanes 42 are located on the housing 12 in order to provide working air openings for the fan 18.

In order to use the combination fan and light attachable to a hat 10 of the present invention, the device is clipped onto the brim B of a hat H (or other appropriate attachment surface) via the clip 40 that clips the combination fan and light attachable to a hat 10 onto the brim B with the resiliency of the clip 40 holding the combination fan and light attachable to a hat 10 in place on the brim B. In this position, the fan 18 is facing toward the face of the wearer of the hat H while the light bulb 24 issues its beam of light outwardly from the wearer's face. The light bulb 24 and/or the fan 18 are activated as desired via the one or more control switches 38. If desired, the filter cap 28 can be attached so that the light issued by the light bulb 24 passes through the two panels 32 and 34 of the split lens so that the light is filtered into two different colors, such as the user's favorite college team colors, for an aesthetic look.

Figure 4:
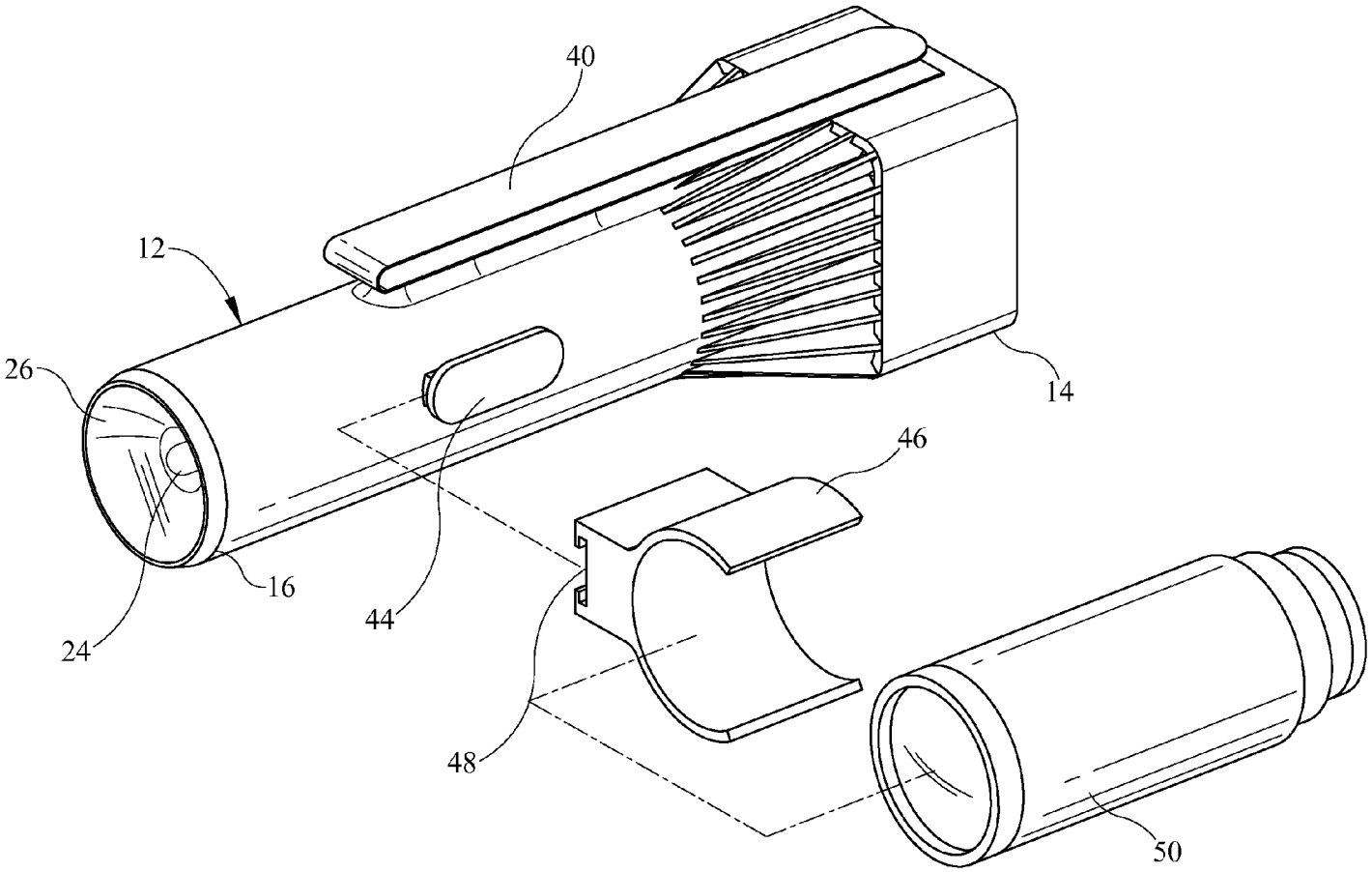
FIG. 4 is a perspective view of the combination fan and light attachable to a hat with an optional monocular.

As seen in FIG. 4, an optional receiver post 44 may be located on the housing 12 such that an attachment clip 46 having a receiver 48 is removably slidable onto the receiver post 44 in dove-tail-like fashion. A monocular 50 is removably receivable within the clip 44 by clipping the monocular 40 into the clip 46. This allows a monocular 50 to be removably receivable on the combination fan and light attachable to a hat 10. One receiver post 44 may be located on each side of the housing 12 so that both left eye dominant and right eye dominant users can effectively use the monocular 450. The monocular 50 can be permanently affixed to the housing 12 in appropriate fashion, however, the use of a receiver post and removably attachable clip 44 allows the combination fan and light attachable to a hat 10 to maintain a relatively low profile, keeps the weight of the combination fan and light attachable to a hat 10 whenever use of the monocular 50 is not needed, and allows for the monocular 50 to be positioned on either side of the housing 12 depending on the eye dominance of the user.

Figure 5:
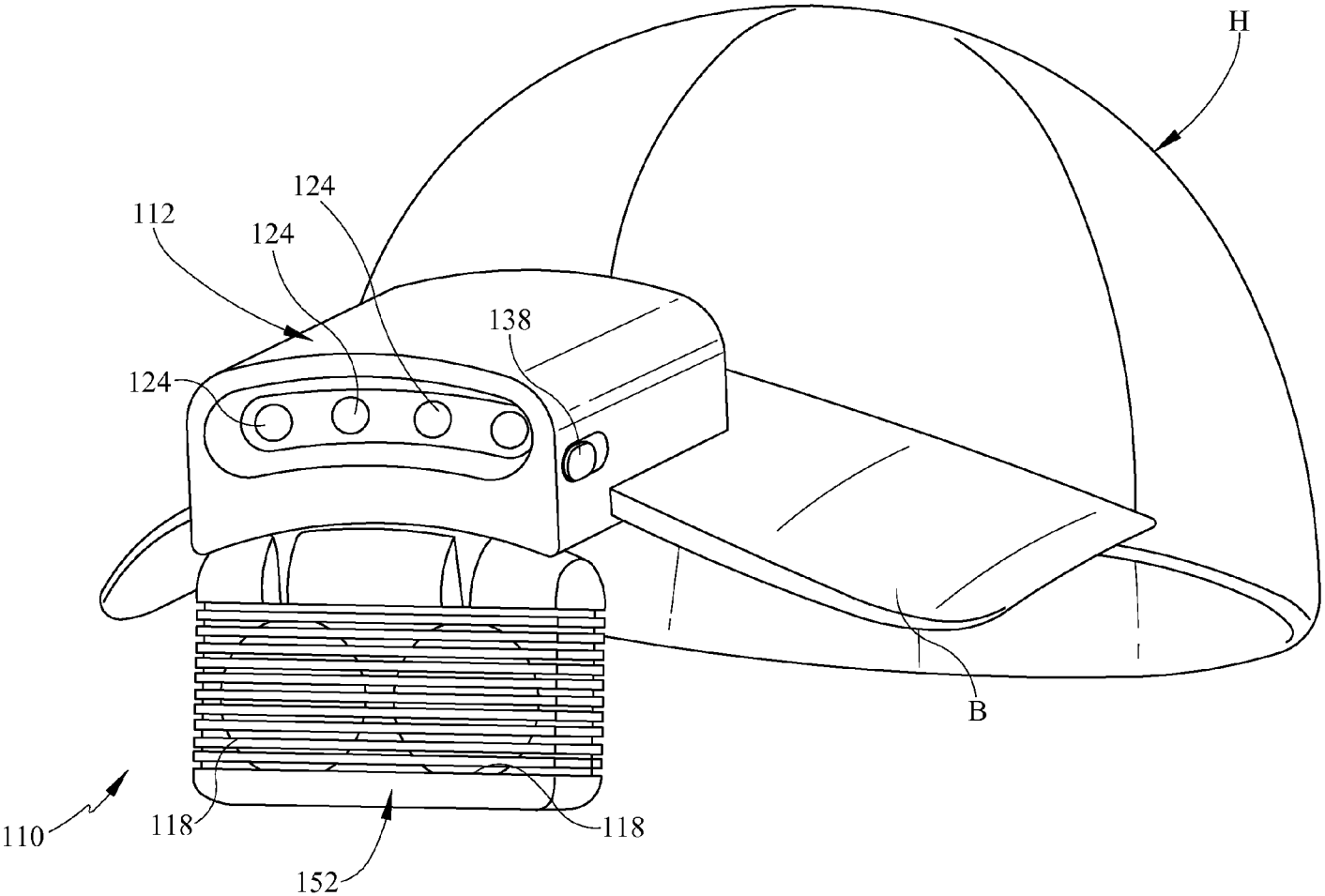
FIG. 5 is a perspective view of an alternate embodiment of the combination fan and light attachable to a hat.
Figure 6:
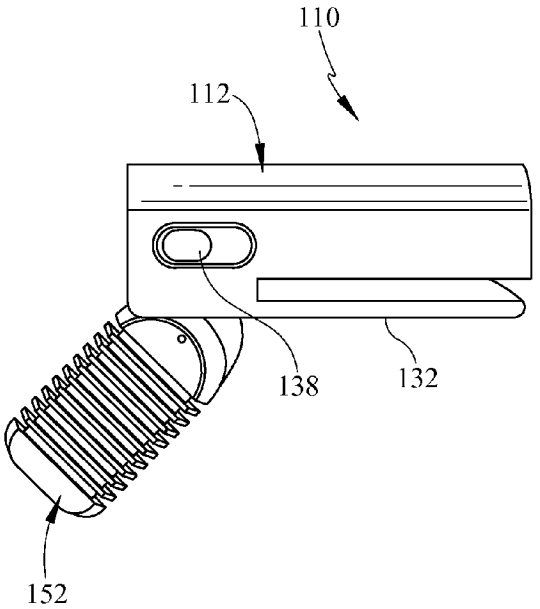
FIGS. 6-8 are side elevation views of the alternate embodiment of the combination fan and light attachable to a hat illustrating the articulation of the hat with respect to the light housing.
Figure 7:
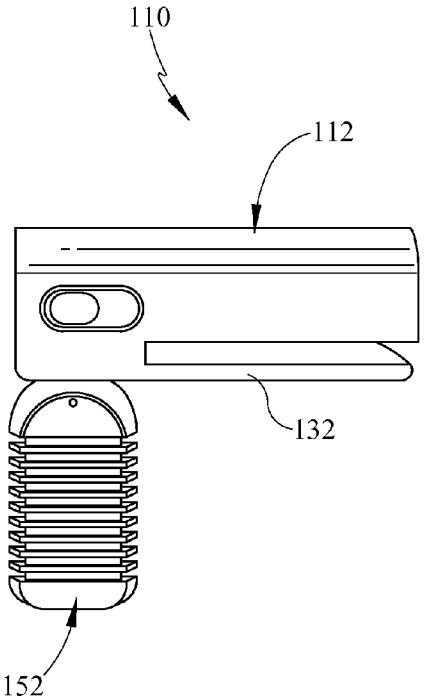
Figure 8:
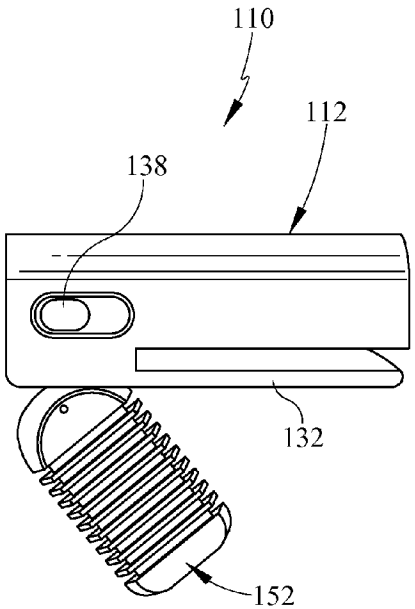

As seen in FIGS. 5 and 6 of the combination fan and light attachable to a hat of the present invention, generally denoted by reference numeral 110, a housing 112 has a series of one or more light bulbs 124 held therein, with a clip 132 attached to the lower surface of the housing 112 and extending rearwardly from the light bulbs 124 with the clip's opening facing in opposite direction relative to the direction of the light issued by the light bulbs 124. The light bulbs 124 may be of any appropriate design including an LED bulb, and may also be a laser type bulb so that the combination fan and light attachable to a hat 110 can be used as a laser aiming device. A combination of light bulb types can be used. A fan assembly 152 is pivotally attached to the lower surface of the housing 112, forward of the clip 132. The fan assembly 152 has on ore more fans 118 held therein that issue a stream of air through diffuser vanes 120 and also draws its working air from the backside vanes 120. One or more batteries (not illustrated) are held within the housing 112 and provide electrical power for the light bulbs 124 and fans 118 and are controlled by one or more switches 130.

The combination fan and light attachable to a hat 110 is clipped onto the brim B of a hat H (or other appropriate attachment surface) via the clip 132 that clips the combination fan and light attachable to a hat 110 onto the brim B with the resiliency of the clip 132 holding the combination fan and light attachable to a hat 110 in place on the brim B. In this position, the fans 118 within the fan assembly are facing toward the face of the wearer of the hat H and the fan assembly 152 can be pivoted into a desired position in order to change the direction of the air stream issued by the fans 118, while the light bulb 124 issues its beam of light outwardly from the wearer's face. The light bulbs 124 and/or the fans 118 are activated as desired via the one or more control switches 130.

While the invention has been particularly shown and described with reference to embodiments thereof, it will be appreciated by those skilled in the art that various changes in form and detail may be made without departing from the spirit and scope of the invention.

I claim:

1. A light and fan assembly comprising:

a tubular housing member having a first end and a second end;

a fan located on a first end of the housing member such that fan issues an air stream outwardly from the first end of the housing in a first direction;

a light assembly located on a second end of the housing such that the light assembly discharges a beam of light outwardly from the second end of the housing in a second direction that is opposite in direction to the first direction;

a clip attached to the housing having an opening facing toward the first end of the housing; and a filter cap removably attached to the second end of the housing in overlaying relationship with the light assembly, such that filter cap has a split lens that has a first panel of a first tint and a second panel of a second tint that is different relative to the first tint such that the beam of light passes through the first panel and the second panel.

2. The light and fan assembly as in claim 1 wherein the fan is a turbine fan.

3. The light and fan assembly as in claim 2 further comprising a diffuser overlaying the fan so that the air stream passes through the diffuser.

4. The light and fan assembly as in claim 3 further comprising a series of intake vanes located on housing such that the fan draws a column of working air for use in producing the air stream through the intake vanes.

5. The light and fan assembly as in claim 4 further comprising a monocular attached to the housing.

6. The light and fan assembly as in claim 5 wherein the monocular is removably attachable to the housing.

7. The light and fan assembly as in claim 1 further comprising a diffuser overlaying the fan so that the air stream passes through the diffuser.

8. The light and fan assembly as in claim 1 further comprising a series of intake vanes located on housing such that the fan draws a column of working air for use in producing the air stream through the intake vanes.

9. The light and fan assembly as in claim 1 further comprising a monocular attached to the housing.

10. The light and fan assembly as in claim 9 wherein the monocular is removably attachable to the housing.

* * * * *